US006764739B2

(12) United States Patent
Orsi

(10) Patent No.: US 6,764,739 B2
(45) Date of Patent: Jul. 20, 2004

(54) ARTIFICIALLY AGED LIST FOR MAKING FRAMES

(75) Inventor: Mauro Orsi, Florence (IT)

(73) Assignee: ORSI Cornici S.R.L., Florence (IT)

( * ) Notice: Subject to any disclaimer, the term of this patent is extended or adjusted under 35 U.S.C. 154(b) by 23 days.

(21) Appl. No.: 10/321,008

(22) Filed: Dec. 17, 2002

(65) Prior Publication Data

US 2003/0110722 A1 Jun. 19, 2003

(30) Foreign Application Priority Data

Dec. 18, 2001 (IT) ..... FI20010099 U

(51) Int. Cl.[7] ..... B32B 3/16; B32B 23/02; B44F 7/00

(52) U.S. Cl. ..... 428/77; 428/79; 428/156; 428/172; 428/192; 428/541; 52/313

(58) Field of Search ..... 428/13, 14, 33, 428/45, 106, 151, 156, 172, 192, 541, 77, 79, 57; 52/313

(56) References Cited

U.S. PATENT DOCUMENTS 4,942,084 A * 7/1990 Prince ..... 428/464
5,718,786 A * 2/1998 Lindquist et al. ..... 156/62.2
6,383,328 B1 * 5/2002 Nakada et al. ..... 156/306.9
6,387,489 B2 * 5/2002 Willemse et al. ..... 428/359

* cited by examiner

*Primary Examiner*—Donald J. Loney
(74) *Attorney, Agent, or Firm*—McGlew and Tuttle, P.C.

(57) ABSTRACT

The list consists of a wooden section whose surface intended to be visible in the frame is partially veneered. The longitudinal edges of the veneer are irregular to obtain an artificially aged appearance of the list.

8 Claims, 1 Drawing Sheet

ARTIFICIALLY AGED LIST FOR MAKING FRAMES

DESCRIPTION

The invention refers to a list which is made in a range of different, relatively long lengths and which is used for the production of relatively inexpensive frames; the cost for making the lists must consequently be very low. The profiled lists are manufactured industrially with equipment which practically does not require direct or expensive labor. The resulting lists are very uniform and consequently the appearance is relatively modest.

Manual operations are required to create special appearance of a list. Such operations have a relatively high impact on the final cost of the list and consequently on the frames which can be made using the list.

The invention relates to a list which is also made with essentially automated procedure, i.e. without the particular employment of labor, but whose appearance effectively conceals the fact that it was manufactured industrially. In other words, the list according to the invention is made practically without the relevant contribution of labor and offers an appreciable appearance, which makes it similar to the lists completed with high cost manual operations.

Essentially, the invention relates to a list for making frames comprising a partially veneered wooden section, and in which the longitudinal edges of the veneer are irregular; an artificial aged appearance of the list is thus obtained.

In practice, the veneer is developed so that the irregular longitudinal edges are close to the longitudinal profiles of the list; consequently, the wood is not very visible on the surface when seen from the section. Additionally, the veneer and the residual uncovered surfaces of the list are advantageously colored to reduce the chromatic differences between the uncovered surfaces of the list and the veneered surfaces.

The drawing shows a possible form of embodiment of the invention; in particular:

Figure 1:
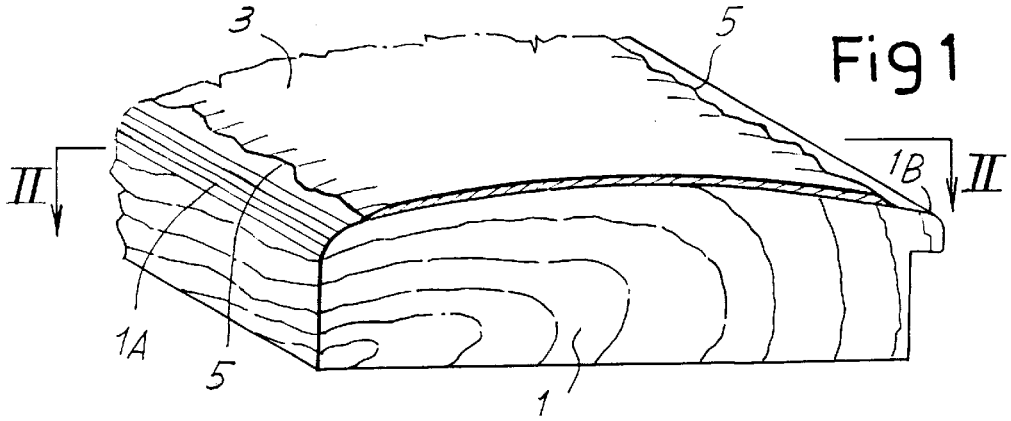
FIG. 1 is a cross-sectional and perspective view of a list according to the invention.
Figure 2:
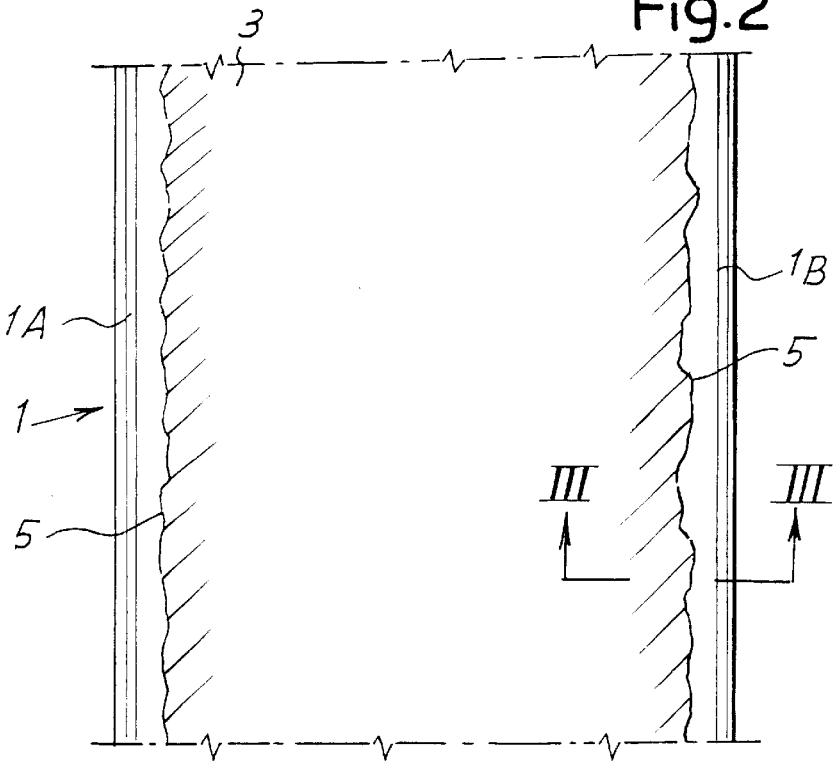
FIG. 2 is a frontal view of a piece of said list according to the line II—II in FIG. 1; e la

In the drawing, reference numeral 1 indicates a section of non valuable wood which is used to make the list. The surfaces intended to be visible in the frames made with this list are veneered at 3 (the covering may also be very thin), e.g. with briar wood or more valuable wood than that used for the list 1, to make the list, and consequently the frames made with the list, appear richer. Normally, for requirements related to cost-effectiveness and to ensure stability of the veneer 3, the veneer is limited to the middle area of the visible surface of the veneered list, the longitudinal edges of the veneer 3 being only slightly distanced from the very curved perimetral areas 1A and 1B of the list 1. These longitudinal edges are regularly and stabily glued without difficulty due to significant curves, such as those of the edges 1A and 1B. The predominant area of the visible surface is covered by the veneer, while visibility of the non valuable wood of list 1 is limited to areas 1A and 1B.

This type of veneering is known per se but veneer 3 is made using a strip of constant width, i.e. whose longitudinal edges are straight. In this way, the veneered frame is partially embellished while maintaining the characteristics of linearity and appearance deriving from industrial production which does not particularly valorize the list made in this way.

According to the invention, on the other hand, the longitudinal edges of the veneer 3, indicated with reference numeral 5, are deliberately irregular thus conferring an aged appearance to the list which is appreciable also in terms of market demand and which is also obtainable using particularly simple and practically automated procedures. This is because the irregular edge 5 of a veneer list, such as that indicated by reference numeral 3, is obtained with cutting tools, such as a circular saw or shears, whose cutting edges are made deliberately irregular, to obtain the irregular pattern of the edges 5 which are cut using the tools. By developing the tools with a relatively long cutting edge, e.g. circular saws with a significant diameter, the repetition of the irregularity of the edges 5 cannot be practically appreciated, also because relatively short sections are used to make frames of normal dimensions. Consequently, the repetition of the profile of the list is practically not visible on the finished frame or is visible at such a distance to be only identified by an expert and very attentive eye.

Figure 3:
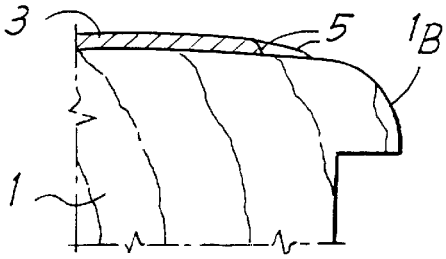
FIG. 3 is a blown-up view of a cross-sectional view detail according to III—III in FIG. 2.

The longitudinal edges 5 are advantageously made by gradually reducing the veneer towards the edges. This ensures a better anchoring of the veneer along the edges and confirms an even more aged appearance than when the edges are formed with a constant, relatively significant thickness, as the thickness of the entire veneer section 3; this gradual reduction of the thickness along the edges 5 is particularly visible in FIG. 3.

What I claim is:

1. A list for forming frames consisting of a partially veneered wooden section, wherein the longitudinal edges of the veneer are irregular to obtain an artificially aged appearance of the list.

2. List for making frames according to claim 1, wherein the irregular edges (5) of the veneer are close to the longitudinal profiles (1A; 1B) of the list.

3. List for making frames according to claim 1, wherein the veneer and the residual uncovered surfaces of the list are treated to reduce the chromatic differences.

4. List for making frames according to claim 2, wherein the veneer and the residual uncovered surfaces of the list are treated to reduce the chromatic differences.

5. List for making frames according to claim 1, wherein the thickness of the veneer is gradually reduced towards the irregular longitudinal edges (5).

6. List for making frames according to claim 2, wherein the thickness of the veneer is gradually reduced towards the irregular longitudinal edges (5).

7. List for making frames according to claim 3, wherein the thickness of the veneer is gradually reduced towards the irregular longitudinal edges (5).

8. List for making frames according to claim 4, wherein the thickness of the veneer is gradually reduced towards the irregular longitudinal edges (5).

* * * * *